United States Patent [19]

Heiland et al.

[11] 4,080,551

[45] Mar. 21, 1978

[54] CIRCUIT FOR PLURAL LAMP CONTROL IN SLIDE PROJECTORS OR THE LIKE

[75] Inventors: Joachim Heiland, Brunswick; Armin Stiller, Hondelage, both of Germany

[73] Assignee: Rollei-Werke Franke & Heidecke, Brunswick, Germany

[21] Appl. No.: 687,681

[22] Filed: May 19, 1976

[30] Foreign Application Priority Data

Jun. 6, 1975 Germany ..... 2525153

[51] Int. Cl.[2] ..... H05B 37/00; H05B 39/02

[52] U.S. Cl. ..... 315/296; 315/198; 315/312; 353/85

[58] Field of Search ..... 315/291, 294, 296, 312, 315/194, 199, 360, 198; 353/85

[56] References Cited

U.S. PATENT DOCUMENTS

| | | | |
|---|---|---|---|
| 3,521,124 | 7/1970 | Bogner | 315/194 X |
| 3,534,224 | 10/1970 | Skirpan et al. | 315/296 |
| 3,684,919 | 8/1972 | Cramer | 315/194 |
| 3,835,349 | 10/1974 | Yancey | 315/194 |

*Primary Examiner*—Eugene R. LaRoche
*Attorney, Agent, or Firm*—Ralf H. Siegemund

[57] ABSTRACT

Two lamps are controlled in that one is off and the other one on or vice versa with fractural transition from one state to the other being controlled by a differential amplifier with integrated, pulse or trigger switch operated Miller integrator. The differential amplifier control circuit elements (transistors, triacs) in separate circuit paths for the lamps. The control is either a direct one (d.c.) or an indirect one through phase shifting of firing pulses in a.c. operated triacs.

10 Claims, 3 Drawing Figures

CIRCUIT FOR PLURAL LAMP CONTROL IN SLIDE PROJECTORS OR THE LIKE

BACKGROUND OF THE INVENTION

The present invention relates to a circuit for controlling the brightness of two light sources in opposite directions particularly for purposes of obtaining a gradual transition from one source to the other; the light sources being, for example, included in a slide projector or pertaining to two slide projectors.

Control circuits for slide projectors are known which include means for adjusting the electric current through the projection lamp and in response to electric control signals. The control circuit may, for example, include a potentiometer whose tapped output is converted into a dc current which in turn is fed through a comparator receiving also a sawtooth or ramp signal. The comparator produces output signals which are pulses whose phase depends on the potentiometer voltage. These pulses control electronic circuit elements such as triacs which in turn control the lamps current.

The potentiometer voltage is used directly to control a frequency variable oscillator being in turn connected to a Schmitt trigger with integrating output. The latter is a dc current which directly represents the adjustment of the potentiometer. Upon using two comparators the circuit can readily be used for the control of two lamps and to effect a gradual transition from one to the other. This circuit as described is rather expensive and includes many expensive electronic components. The transition itself results from manual operation of the potentiometer slide unless one includes a motor drive for just that purpose. Therefore, the regularity and smoothness of the transition depends on the evenness of the manual changeover.

DESCRIPTION OF THE INVENTION

It is an object of the present invention to provide a circuit for controlling the brightness of two sources of light in opposite direction whereby the control and here particularly the transition results from just actuating a key or switch and runs automatically at a predetermined rate to completely dim one lamp and to gradually increase the brightness of the other lamp; the expenditure for the circuit is to be minimal.

In accordance with the preferred embodiment of the present invention the control circuit for the two lamps to be controlled in opposition is to include a pair of control elements for individually controlling the current flow through the lamps. A differential amplifier provides two oppositly changing outputs for the control of the elements. The differential amplifier includes i.e., has incorporated an intergrating circuit responding to input trigger signals and gradually changing from one level to another, and in the reverse if triggered again, for obtaining a gradual changeover of the outputs of the differential amplifier. The other input of the amplifier provides a constant bias. The integrator is preferably constructed as Miller integrator which is thus being triggered and changes automatically. In the preferred from, the input circuit of the Miller integrator includes a variable resistance which is connected by simple switching action either to one or the other source of two sources of dc potential biasing the circuit as a whole. The switch may be a manual switch or a flip-flop which is being triggered by an input key. In either case switch actuation causes the integrator to change state in a gradual manner, and if the lamps pertain, for example, to two projectors, one obtains a smooth changeover from one to the other.

The differential amplifier is basically constructed in the usual manner except that the output stage of the Miller integrator is incorporated as an input stage in the amplifier. Moreover, the constant bias as well as the resistor configuration include preferably similar resistors throughout to obtain symmetry of operation. The differential amplifier may have its two outputs directly connected to the control elements which control the lamp currents. Alternatively and particularly, if the lamps are supplied with a.c., these control elements may be of the variety which require particularly phased firing pulses so that trigger signal generators are provided which produce firing pulses changing in opposite direction, and in the stable state they hold the lamp current down in one lamp but permit maximum current flow in the other one.

Preferably, the output of the differential amplifier is combined with the output of a sawtooth generator to obtain particular, combined signals for each of the trigger signal generators which composite signals, in turn, are used to control the generation of particular trigger pulses. Utilization of a single sawtooth generator suffices, and the differential amplifier shifts individually the effective levels so that the two resulting trigger pulses, if varied, vary at the same rate and in opposite directions so that the lamp current in one lamp is controlled from dark to bright at the same time it takes for the other lamp to darken from full brightness to almost or completely off and whereby, furthermore, the same rule applies for another changeover and transition of the illumination in the opposite direction.

The preferred embodiment includes a particular construction for the sawtooth generator in that it includes a Miller integrator with two outputs varying in unison, and the respective trigger circuits each include a programmable unijunction transistor which is fired by the sawtooth voltage as combined with one differential amplifier output. Upon firing a trigger pulse is generated. The transistor is extinguished at the end of each a.c. half wave. The circuit may be supplemented by a particular trigger stage operated by the differential amplifier each instance the differential amplifier changes outputs states regardless of the direction.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
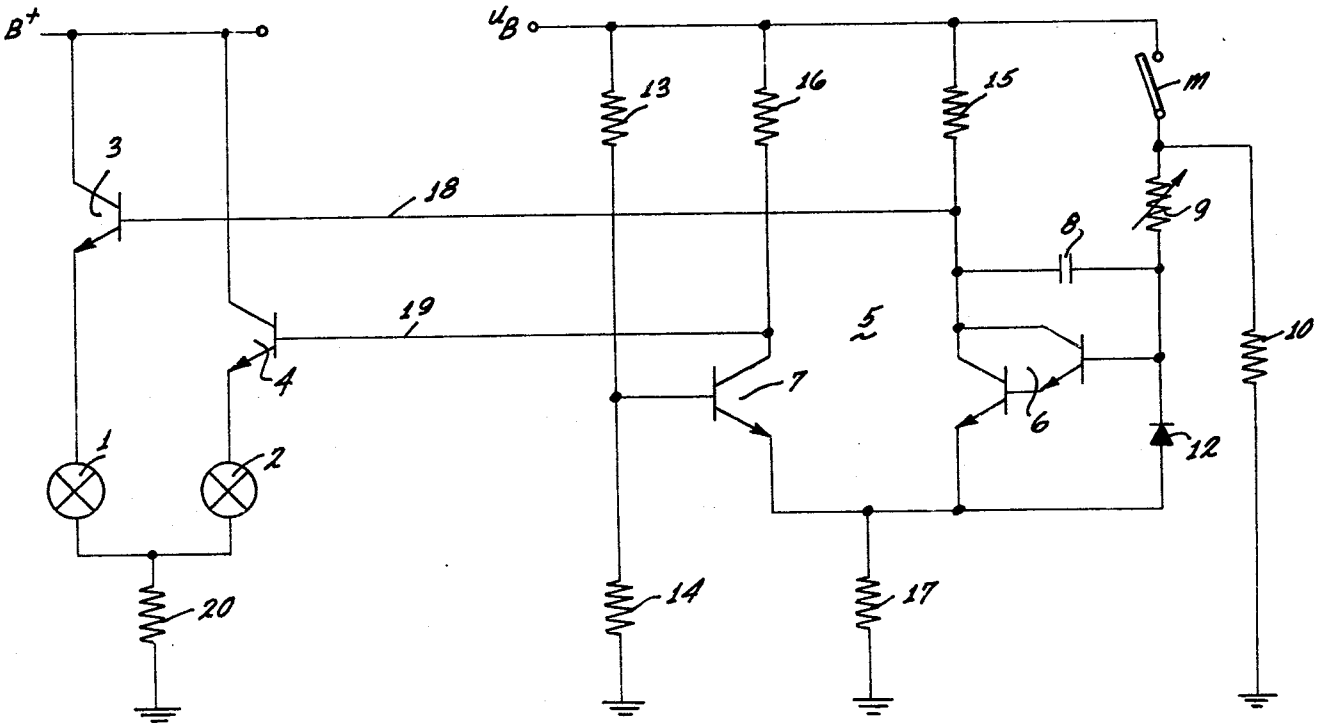
FIG. 1 shows a circuit for controlling two lamps in accordance with the preferred embodiment invention, using d.c. for feeding the lamps.

Proceeding now to the detailed description of the drawings, elements used in all Figures and both embodiments bear the same reference numerals. In each instance there are provided two lamps 1 and 2 to be controlled as to brightness in the opposite sense in relation to each other. Particularly the current in the circuit branch containing lamp 1 shall rise from zero to maximum during the same period of time the current in the other branch (lamp 2) drops from a maximum or normal value to zero, and vice versa.

In FIG. 1 the lamp current is controlled by means of the two transistors 3 and 4 serving here as lamp control elements and being respectively connected in series with the two lamps 1 and 2. The two branch circuits are connected in parallel between a source of d.c. potential B+ and ground, sharing however a common bias resistor 20.

The two transistors 3 and 4 have their respective base electrodes connected to be controlled by signals which arrive via signal lines 18 and 19 and originate, possibly, remote from the lamps and their control transistors. These signals are generated in a circuit to be described next. This particular control circuit includes a differential amplifier 5 having a first input stage constructed as Miller integrator 6. The outer input stage of the amplifier is established by just a transistor 7. The Miller integrator 6 is constructed as Darlington circuit of which the output stage constitutes and is incorporated to serve as the one input stage for the differential amplifier. The Darlington circuit is characterized by interconnected collector electrodes and by an emitter to base connection between input and output transistors. The base electrode of the input transistor is connected to the interconnected collector electrodes by means of an integrating capacitor 8. In addition, the input base electrode of the Darlington circuit is connected to the emitter of its output stage by a diode 12 for purposes of bias.

The third connection regarding the base of the input stage of the Darlington circuit 6 leads to a variable or adjustable resistor 9 which can be connected either directly to the supply voltage UB by switch 11 or, upon opening switch 11, the resistor 9 is connected to ground via a fixed resistor 10.

The base electrode for transistor 7 is connected to the other input circuit for this differential amplifier established here by a voltage divider having two resistors 13 and 14 which are connected serially between UB and ground. Thus, the second input of the differential amplifier is biased to a fixed level. The two collector circuits of the two input stages of the differential amplifier 5 are separately connected to UB via resistors 15 and 16, respectively. The emitter electrodes of the two main active stages of the differential amplifier are interconnected for common bias by a resistor 17 which connects to ground.

The circuit is designed so that resistors 13 through 17 all have the same value. This way one obtains the same transient response and change in state covering the same period of time upon closing as well as upon opening switch 11. Moreover, upon full conduction by either of the two differential amplifier transistors, the respective collector potential is about UB/2. The collectors of these two stages 6 and 7 are respectively connected to the signal lines 18 and 19 and provide the control signals for the transistors 3 and 4 accordingly. In the steady state, one of these signals will be UB, the other one UB/2.

The circuit of FIG. 1 operates as follows. It may be assumed that switch 11 is open in which case Miller integrator 6 is blocked and transistor 7 is conductive. Therefore, the collector of the output stage of circuit 6 applies a voltage UB to the line 18. The capacitor 8 is charged in that the plate connected to the collector of the output stage of circuit 6 has the voltage potential of UB while the other plate is grounded. On the other hand, transistor 7 conducts and due to the similarity of resistors 16 and 17, a voltage of UB/2 is applied to line 19. Thus, the transistor 3 receives the control signal UB, and the transistor 4 receives the control signal UB/2. The resistor 20 has a value so that upon full current flow through one of the lamps, the voltage drop across resistor 20 equals UB/2. Thus, transistor 4 whose gate receives UB/2 is, in fact, biased off, and no current flows through lamp 2. Consequently, fully rated or maximum current flows through lamp 1 which is fully on and transistor 3, of course, is fully conductive.

As soon as switch 11 is closed, capacitor 8 begins to change charge state, that is to say the capacitor tends, at first, to equalize the charge across its plates. The rate of change is primarily determined by the resistor 9 and by its adjustment in particular. The base of the Miller integrator input increases in potential. As the Miller integrator does, in fact, become conductive, current flow is diverted into and through the output stage of the Miller integrator which is also the one input stage for the differential amplifier. On the other hand, the current flow through transistor 7 becomes gradually throttled and at the same rate. Accordingly, the voltage in line 18 drops at the same rate the voltage in line 19 rises. Necessarily, the transistor 4 becomes gradually conductive and conduction through transistor 3 is gradually throttled so that lamp 1 is dimmed while lamp 2 begins to shine.

With increasing conduction through the Miller integrator the electrode plate of capacitor 8 connected to resistor 15 assumes the potential UB/2 while the other electrode of the capacitor is charged towards UB. This means during the transition period the voltage across the capacitor changes from UB in the one direction to a voltage UB/2 with reverse polarity. The entire charge current is determined by the adjustment of transistor 9. A new stable state is assumed when the integrator 6 is fully conductive and applies UB/2 to the transistor 3 via line 18 while at the same time transistor 7 is fully off and its collector applies the voltage UB to the transistor 4. Lamp 1 is now off and lamp 2 shines in full. This state remains as long as switch 11 remains closed. Upon opening switch 11, the situation reverses at the same rate because the rate of charge reversal on capacitor 8 is again determined by the operation of resistor 9.

The rate of change of the charge state of capacitor 8 determines the rate in which the junction of elements 6, 8, and 15, which is connected to line 18, changes from UB to UB/2 or from UB/2 to UB by operation of the differential amplifier 5. The collector of transistor 7 is slaved to that change and follows it but in the opposite direction.

Turning now to FIG. 2, there are shown again two lamps, 1 and 2, but they receive power from a source 28 of a.c. potential. Each lamp is respectively connected in series with a triac, 26 and 27, which control elements are controlled as to firing by means of phase shifted and adjusted control pulses. These pulses are generated in circuits 29 and 30 in a manner to be described more fully below.

Generally speaking, circuits 29 and 30 are trigger signal generators which receive control signals from a sawtooth or ramp signal generator 31 also to be described below. The trigger generator 29 has particularly output terminals 55, 56, which connect respectively to one main electrode to triac 26 and to the gate thereof. Trigger 30 is analogously connected to triac 27. The ramp signals as produced by circuit 31 are, in fact, produced in phase synchronism with the a.c. power supply as driving the lamps. For purposes of signal isolation, generator 31 has two output terminals 31*a*, 31*b*, which provide the same signal but through isolating resistances within the generator as will be described below.

The ramp signals are combined with d.c. control signals from the differential amplifier 5 having the same function and being similarly configured as was described by reference to FIG. 1. However, the signal lines 18 and 19 include matching resistors 32 and 33. Reference numerals 29*a* and 30*a* refer to signal summing points in which the output signals of differential amplifier 5 and the output ramps signals from circuit 31 are combined. The resulting inputs determine the phases of the firing pulses for the triacs 26 and 27. Since these voltages in signal lines 18 and 19 are normally different (they are similar briefly during the transition period) the phase angles of firing the triacs are different accordingly, and they change in the opposite direction whenever such a change is commanded.

Figure 2:
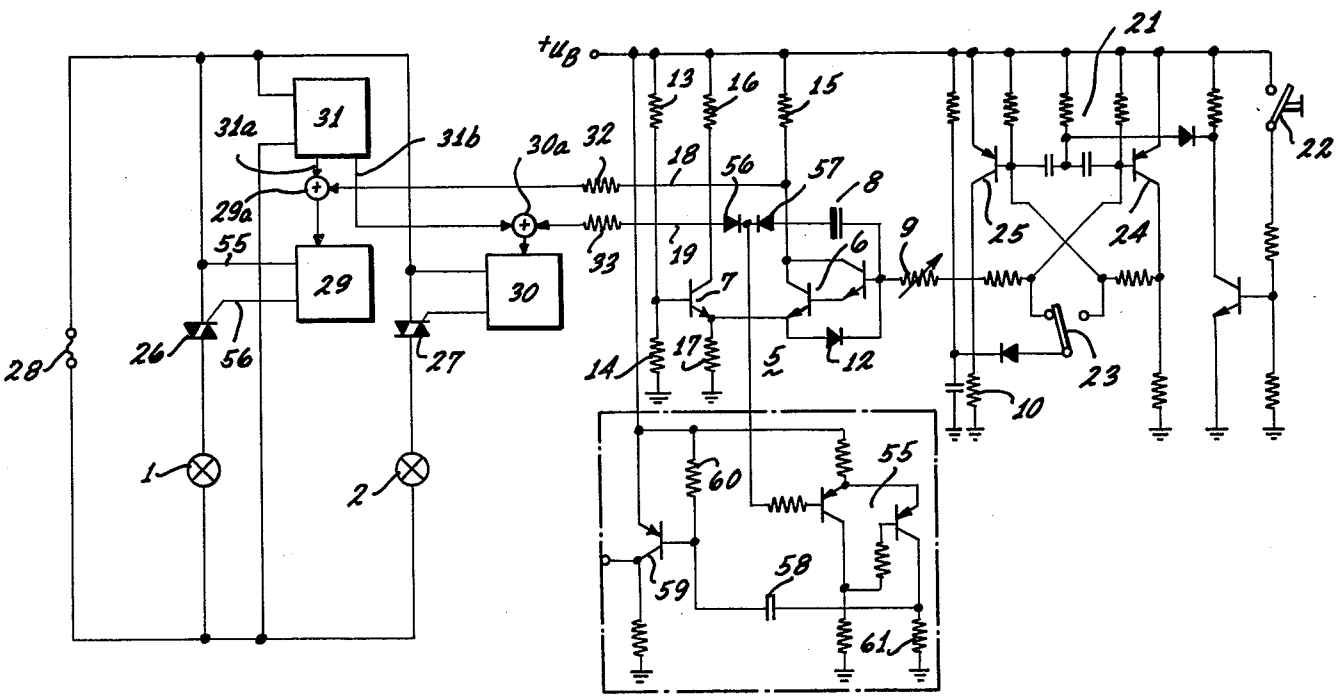
FIG. 2 illustrates an a.c. circuit for such lamps control using, however, many elements also used in FIG. 1.
Figure 3:
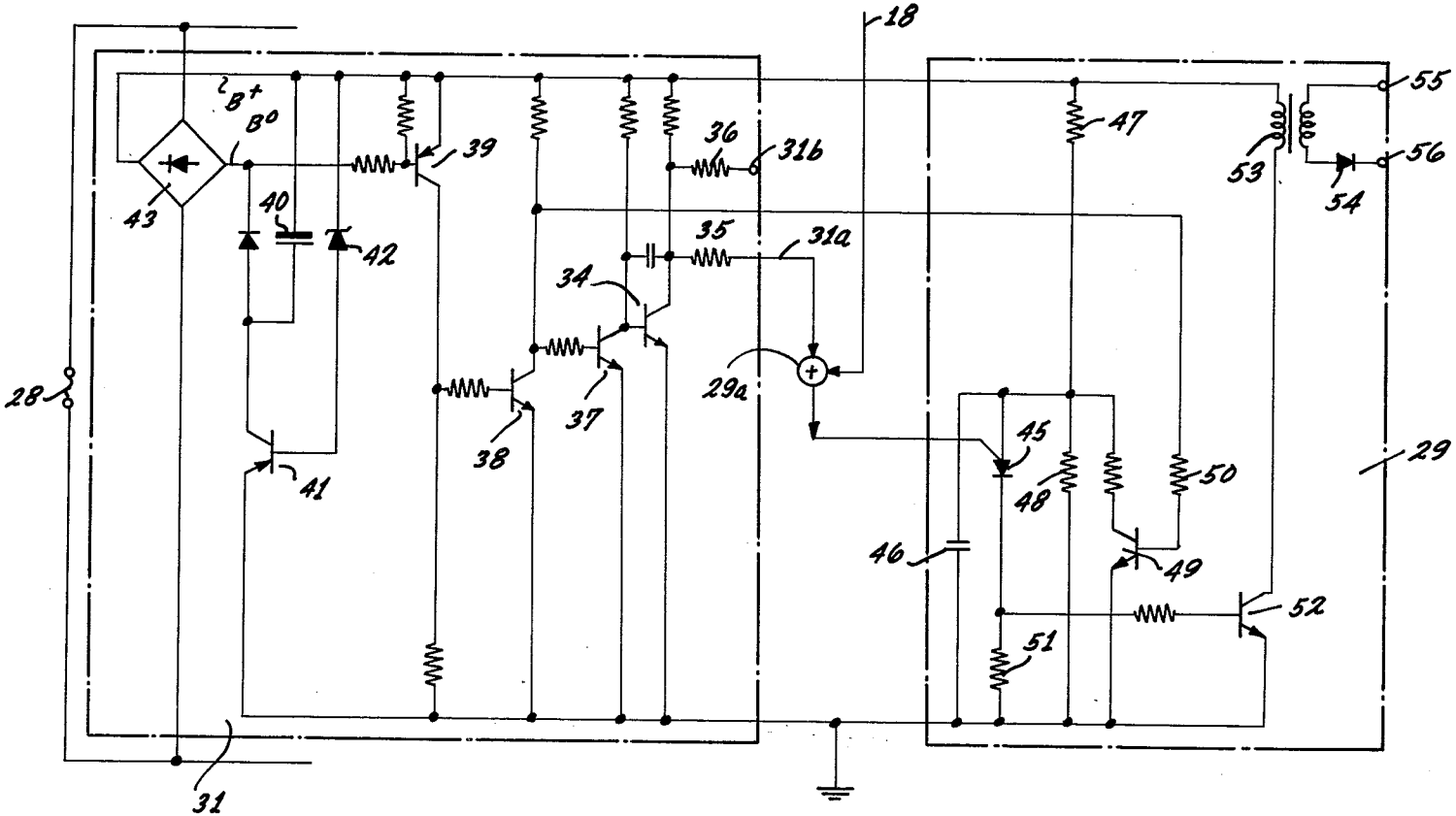
FIG. 3 is a circuit diagram showing the preferred embodiment for a sawtooth generator and of a trigger stage as used in the circuit of FIG. 2.

Before describing generator 31 and one of the trigger stages 29 as per FIG. 3, the circuit of FIG. 2 shall be explained further. As was stated, it includes a similarly constructed differential amplifier 5 including particularly the Miller integrator 6, 8. However, the switch 11 has been replaced by a flip-flop 21 which changes state and responds to the actuation of a key 22. The flip-flop is of conventional design and includes transistors 24 and 25 interconnected particularly as a d.c. toggle flip-flop. It includes, however, a switch 23 whose position determines the state of the flip-flop when the power is turned on for the first time. This way one obtains a definite state of the flip-flop right at the beginning which will be reflected in a particular lamp being turned on at that time.

Switch 23 when in the illustrated position causes transistor 24 of the flip-flop to be conductive while transistor 25 is nonconductive. This state of the flip-flop is equivalent to the position of switch 11 as shown in FIG. 1, as far as the outputs of the differential amplifier is concerned. However, the states of the lamps is reversed because lamp 2 is on while lamp 1 is off for the closed position of switch 11.

Upon pressing key 22 temporarily, flip-flop 21 changes state, and the state of conduction of transistors 24 and 25 reverses accordingly, corresponding to the alternative position of switch 11. Upon pressing the key 22 again the flip-flop will change state again. In each instance the differential amplifier changes outputs and in a gradual manner by operation of the Miller integrator 6 as was described earlier and the signals in lines 18 and 19 are developed also as described.

Reference numeral 55 refers to an additional Schmitt trigger whose input is derived from the differential amplifier 5 via two front-to-front connected diodes 56 and 57, deriving a common output from the two output terminals of amplifier 5. The anodes of the diodes are connected to the collectors of the two stages 6 and 7 accordingly.

The output of Schmitt trigger 55 is connected to the base electrode of a transistor 59 via a capacitor 58. A resistor 60 biases transistor 59 to be normally off. The Schmitt trigger develops a negative voltage across the output resistors 61 at the end of each changeover in the differential amplifier, regardless of the direction in which it took place. This negative voltage is transmitted by a capacitor 58 to transistor 59 rendering it conductive for a short period of time, and a positive pulse is provided at the output of the collector of transistor 59. This positive signal can be used in any desirable manner, for example, as an additional control signal or as an indicator. It appears always whenever a change in state of the differential amplifier 5 has taken place.

Next, we turn to the description of the sawtooth generator 31 and of one of the two trigger signal generators, for example, 29. The circuit 30 is constructed identically and, therefore, does not require additional illustration.

The sawtooth ramp generator 31 is connected to the source 28 of a.c. potential via a full wave rectifier 43. The rectifier 43 has a high output termed B+ and a low output termed B°. Across these d.c. output terminals the full wave voltage swings are developed as a sequence of half waves. That output is used directly for purposes of control to be described shortly. In addition, however, the low voltage side B° of the rectifier is connected to a smooth capacitor 40 via a blocking rectifier which prevents the smoothing to take effect directly at that particular terminal, B°. In addition, a stabilizing circuit comprised of a transistor 41, and a zener diode 42 establishes a stabilized d.c. voltage relative to B+ and to be used as such in the circuit to be described next. The emitter of transistor 41, for example, is grounded. The stabilized voltage is also used in the trigger stages 29 and 30. However, the unsmoothed voltage across the rectifier bridge (terminal B°) is applied directly to the emitter-base path of a transistor 39 being the first one of three stages 39, 38, and 37, which drive a Miller integrator 34. The Miller integrator 34 has two parallel output circuits established by two resistors 35 and 36 which couple the integrator to the two output terminals 31*a* and 31*b* of the ramp generator 31. Terminal 31*a* is shown also here as connected to one input of summing point 29*a*. The other input connects to line 18. Actually, the resistor 32 in that line and resistor 35 as interconnected suffice to establish the summing point.

The Miller integrator receives, therefore, a pulsating voltage as it is derived from the rectifier 43 without filtering and the half wave pulses, or course, occur at a rate which is twice the frequency of the source 28. The circuit and particularly the stages 37, 38, and 39, are adjusted so that the Miller integrator 34 is connected to receive a half wave a.c. for most of its occurrence. As a consequence, a ramp signal is generated with each half wave and retraced at the end of each such half wave so that the sawtooth repetition rate is indeed twice the a.c. frequency. The ramp signal is developed by and at the collector electrode of the Miller integrator 34 and applied twofold to the two terminals 31*a* and 31*b*.

The particular trigger signal generator 29 includes as its main active element a grogrammable unijunction transistor 45 or PUT. The anode-cathode pass of PUT 45 is bridged by a capacitor 48. The anode of PUT 45 is connected to the junction of a voltage divider 47 and 48 being connected to the d.c. supply and derived from the rectifier 43 via the stabilizing and smoothing circuit of the sawtooth generator 31. The gate of PUT 45 is connected to the output of summing point 29*a*. Thus, the gate of PUT 45 receives the combined ramp signal from the Miller integrator but shifted as to its effective level by the voltage in the line 18 as derived from the differential amplifier 5. The combined signal, of course, is still a ramp signal that varies in time and in periodically repeated synchronism with each a.c. half wave. The cathode of PUT 45 is connected to ground via a resistor 51. The bias of PUT 45 as to its anode-cathode path is effective so that the PUT will fire for a particular gate voltage. The point in time of firing is determined by the ramp particularly in relation to the a.c. voltage as applied to the system.

The PUT 45 and its cathode resistor 51 is additionally bridged or bridgable by a transistor 49 whose base is connected to receive a signal which is pulsating d.c. and is derived from the stage 39 via a resistor 50. The collector of the transistor 38 has low d.c. voltage potential during most of the half wave. Towards the end of each half wave transistor 38 is blocked briefly and its collector potential rises to a high d.c. voltage. This then results in a trigger pulse for the transistor 49 rendering it conductive and in effect bridging the PUT for extinguishing it.

Whenever the PUT 45 is fired capacitor 46 discharges and a high voltage peak is developed across the cathode resistor 51 which, in effect, serves as a driving signal for a transistor 52. This voltage drop across 51 is particularly applied across the base emitter path of NPN transmitter 52. The collector of this transmitter is serially connected to the primary winding of a pulse transformer 53 whose secondary winding is connected to the output terminals 55 and 56 introduced above and via a diode 54. Thus, a pulse in a particular direction is introduced whenever the transistor 52 is rendered conductive and drives a current peak through the transformer primary to produce a firing pulse of proper polarity for the triac 26, being connected to the transistor terminals 55 and 56. The generator 30 as controlling triac 27 is analogously constructed and operates just as circuit 29. The only difference in each circumstance, of course, is that the phase position of the firing pulses so produced differ.

The circuit shown in 2 and 3 operate as follows:

If one assumes that switch 23 and key 22 have the illustrated position, and key 22 was pressed once then lamp 1 is on at maximum brightness while lamp 2 is dark. Amplifier 5 in output 18 adds a biasing voltage $U_B^2$ to the saw tooth ramp so that PUT 45 therein fires shortly after the beginning of each a.c. half wave. Thus, trigger circuit 29 provides a trigger signal at the beginning of each half wave. The output 19 adds a bias $U_B^2$ to the ramp so that the PUT 45 is fired very late or not at all so that the trigger signal, if provided by circuit 30, appears only toward the end of each half wave. The trigger signals, thus, have the proper phase so that triac 26 is conductive most of the time while a triac 27 conducts only briefly in each half wave if at all.

As soon as key 22 is pressed briefly, flip-flop 21 changes state and transistor 25 ceases to be conductive while transistor 24 becomes conductive. This change in state of conduction occurs, of course, at a rather high speed. As was described earlier, the Miller circuit 6 changes slower, and the voltage between lines 19 and ground drops gradually from UB to UB/2 while the voltage in line 18 rises from UB/2 to UB. These changes occur also at a much slower rate than the a.c. signal frequency rate. However, that rate is independent from the duration of pressing key 22. The output voltages of the differential amplifier 5 are added to the sawtooth signal in summing points **29*a* and 30*a* and are applied to the respective PUTS; 45** being one of them. As a consequence, the firing of one PUT is retarded and advanced in the other one.

The instantaneous voltages at the summing points determine the relative phase of firing the PUTS. Specifically, and in the case to be described, the output voltage of the summing point **29*a* rises in that the level from which the ramp rises and to which it returns rises from UB/2 to UB. Accordingly, the point in time of firing of PUT 45 is increasingly retarded, i.e., it shifts to later phase points in relation to the beginning of each a.c. half wave. Accordingly, the pulses produced by transformer 53 occur late, and the triac 26 is fired later and later to obtain a decreasing current flow in lamp 1**.

The phase of the firing pulse for triac 27 will be advanced, so that the current flow in lamp 2 increases. As soon as Miller integrator 6 has obtained its other state, triac 27 is fired right after the beginning of each half wave while the trigger pulses for triac 26 are delayed to be close to the end of each half wave so that lamp 2 is now fully on and lamp 1 is fully off. The period of transition is exclusively determined by the adjustment of resistor 9, of course, in cooperation with other elements in the charge-discharge circuit for capacitor 8.

The invention is not limited to the embodiments described above but all changes and modifications thereof not constituting departures from the spirit and scope of the invention are intended to be included.

We claim:

1. A device for controlling two sources of light in opposing directions, such as projector lamps for slide projectors or the like, comprising:

a pair of control elements connected for individually controlling current flow through the lamps, each of the elements having a control input terminal;

a differential amplifier having a pair of input circuits and a pair of output terminals, signals at the output terminals varying in opposition to each other;

circuit means for individually connecting the output terminals of the amplifier to the input terminals of the control elements of the pair;

a constant bias incorporated in one of the input circuits of the differential amplifier; and an integrating circuit incorporated in the other one of the input circuits of the differential amplifier and responding to input triggering for generating an input for the differential amplifier gradually changing from one level to another or in the reverse whereby the output signals of the differential amplifier change in opposing directions.

2. A device as in claim 1 wherein the integrating circuit is constructed as Miller integrator having an input which receives signals in response to which the integrator changes state gradually.

3. A device as in claim 2 wherein the Miller integrator includes a variable resistor across which said signals are applied so that the variable input of the differential amplifier requires the same period of time for changing outputs in one or in the other direction.

4. A device as in claim 1 wherein the differential amplifier is constructed from two transistors having their emitters interconnected and connected through a first resistor to a first source of d.c. potential, the collectors of the two transistors being connected through a second and third resistor respectively to a second source of d.c. potential, the one input circuit including a pair of resistors connected across the sources of potential in voltage divider configuration, all of said resistors having the same resistance value.

5. A device as in claim 1 wherein the amplifier includes a pair of transistors in common emitter configuration, one of the transistors of the pair being the output stage of the integrator and includes a diode connected to the eimitter of the transistor and further connected for beasing the base thereof.

6. A device as in claim 1 wherein the circuitry includes a direct connection between the output terminals of the differential amplifier and the control inputs of the pair of controlled elements.

7. A device as in claim 1 wherein the circuit means includes a pair of trigger pulse generators and a sawtooth generator, signals of the differential amplifier being combined with the sawtooth wave as provided by the generator to provide phase control for the generation of trigger pulses by the generators.

8. A device as in claim 1, wherein said integrating circuit includes a single line input circuit connected to a switch means; two sources of different potentials being independant from the differential amplifier and connected to the switch means so that the switch means applies one or the other potential to the single line input for obtaining said level changes.

9. A device as in claim 8, wherein the switch means is a manual switch connecting one or the other sources of potential to said line.

10. A device as in claim 8, wherein said switch means includes a bistable device and a key connected to the bistable device so that the device changes state each time the key is pressed.

* * * * *